US012589288B2

(12) United States Patent
Tsao

(10) Patent No.: US 12,589,288 B2
(45) Date of Patent: Mar. 31, 2026

(54) DESKTOP ELASTIC LAUNCH GAME DEVICE

(71) Applicant: Chung-Piao Tsao, Taipei City (TW)

(72) Inventor: Chung-Piao Tsao, Taipei City (TW)

( * ) Notice: Subject to any disclaimer, the term of this patent is extended or adjusted under 35 U.S.C. 154(b) by 929 days.

(21) Appl. No.: 17/865,416

(22) Filed: Jul. 15, 2022

(65) Prior Publication Data

US 2024/0017161 A1 Jan. 18, 2024

(51) Int. Cl.
*A63F 7/24* (2006.01)
*A63F 7/00* (2006.01)
*A63F 7/36* (2006.01)

(52) U.S. Cl.
CPC ..... *A63F 7/2481* (2013.01); *A63F 7/0017* (2013.01); *A63F 7/36* (2013.01); *A63F 2007/367* (2013.01); *A63F 2007/3674* (2013.01)

(58) Field of Classification Search
CPC ..... A63F 7/2481; A63F 7/0017; A63F 7/36; A63F 7/06; A63F 2007/3674; A63F 2007/367
See application file for complete search history.

(56) References Cited

U.S. PATENT DOCUMENTS 1,593,421 A * 7/1926 Blum ..... A63F 7/0017 273/108.5
3,082,003 A * 3/1963 Mcconathy ..... A63F 7/0017 273/123 R
3,734,504 A * 5/1973 Breslow ..... A63F 7/0017 273/126 R
4,166,620 A * 9/1979 Sheppard ..... A63F 7/0017 273/127 B
4,560,163 A * 12/1985 Erickson ..... A63F 7/0668 273/108.1
5,516,102 A * 5/1996 Polk, III ..... A63F 7/26 273/119 R
5,785,615 A * 7/1998 Kosmalski ..... A63B 67/04 273/108.5
5,882,007 A * 3/1999 Gay ..... A63F 7/0668 273/108.1
5,975,526 A * 11/1999 Hoffman ..... A63F 7/0668 273/108.1
6,457,711 B1 * 10/2002 Baulesh ..... A63B 67/002 273/108.1

(Continued)

FOREIGN PATENT DOCUMENTS

ES 2264872 A1 * 1/2007 ..... A63F 7/0017

*Primary Examiner* — Raleigh W Chiu
(74) *Attorney, Agent, or Firm* — Leong C. Lei

(57) ABSTRACT

A desktop elastic launch game device includes a carrying body in the form of a rectangular flat board and having a predetermined height; a wall body higher than the carrying body and circumferentially arranged around a perimeter of the carrying body; a separation board arranged on the carrying body to have two ends mounted to the wall body and being formed, in a bottom portion, with a hollowed portion corresponding to the through holes; a plurality of elastic bodies, each of which has two ends that are mounted to opposite portions of the wall body and arranged adjacent to each of the through holes; and a plurality of plate bodies, which are placeable against each of the elastic bodies so that the plate bodies are selectively launched out toward the hollowed portion by a spring force of the elastic bodies.

8 Claims, 5 Drawing Sheets

(56) References Cited

U.S. PATENT DOCUMENTS

| | | | | |
|---|---|---|---|---|
| 6,554,278 | B1 * | 4/2003 | Haddox | A63F 7/0023 273/123 R |
| 6,764,074 | B2 * | 7/2004 | Bangerter | A63F 7/06 273/108.1 |
| 2010/0201067 | A1 * | 8/2010 | Liao | A63F 7/06 273/108.1 |
| 2022/0305360 | A1 * | 9/2022 | Tattini | A63B 67/10 |
| 2023/0001277 | A1 * | 1/2023 | De Goyeneche Parker | A63B 67/14 |
| 2024/0017161 | A1 * | 1/2024 | Tsao | A63F 7/36 |

* cited by examiner

DESKTOP ELASTIC LAUNCH GAME DEVICE

TECHNICAL FIELD OF THE INVENTION

The present invention relates to an elastic launch game device, and more particularly to a paper-made, lightweight, and unpluggable desktop elastic launch game device.

DESCRIPTION OF THE PRIOR ART

The modern urban living is quick and tense. Proper mental relaxation is necessary. Playing games in amusement arcades is one of the simplest ways of entertainment. To provide diversified or a variety of entertainment, new games have been developed and presented to suit the general consumers' needs. For example, an air hockey game comprises multiple vent holes uniformly distributed on a table surface and air is supplied from the vent holes to have a puck, which is placed on the table surface, raised upward and cushioned by the air on the underside in a suspended or floating state. Such an air cushion provides a main effect of allowing the puck to move extremely quickly. Opposing players standing on two opposite sides of the table and each holding a striker, which is of a flat form similar to the puck and serves as a tool for striking the puck back, strike the puck back and forth to thereby achieve extreme excitement of entertainment.

However, considering the known air hockey table, since the puck moves very quickly and the striker does not have a great width, there are always situations when the players' hands do not respond quickly enough, meaning the game may be hard to play. This constrains the applicability of the game. Further, the players are standing just next to the table for playing the game, and this makes the table surface unprotected. The table may be easily damaged. Further, the quick movement of the puck may hurt the players' hands, leading to safety issues. Thus, there is a need for further improvement.

Further, the known air hockey table is generally of a large size, and must be powered with electricity for game playing. This leads to constraints in respect of space.

SUMMARY OF THE INVENTION

The primary objective of the present invention is to provide a desktop elastic launch game device, which comprises: a carrying body, which is in the form of a flat board in a rectangular shape, the carrying body having a predetermined height from a bottom surface to a top surface; a wall body, which has a height higher than the top surface of the carrying body, the wall body being mutually connected and circumferentially arranged around a perimeter of the carrying body, the wall body having a predetermined width; a separation board, which is arranged on the carrying body and has two ends mounted to an inside surface of the wall body, the separation board having a bottom portion that is formed with a hollowed portion corresponding to each of the through holes; a plurality of elastic bodies, each of which has two ends that are mounted to opposite portions of the inside surface of the wall body, each of the elastic bodies being arranged adjacent to each of the through holes; and a plurality of plate bodies, which are placeable against each of the elastic bodies so that the plate bodies are selectively launched out toward the hollowed portion by a spring force of the elastic bodies.

DETAILED DESCRIPTION OF THE PREFERRED EMBODIMENT

Figure 1:
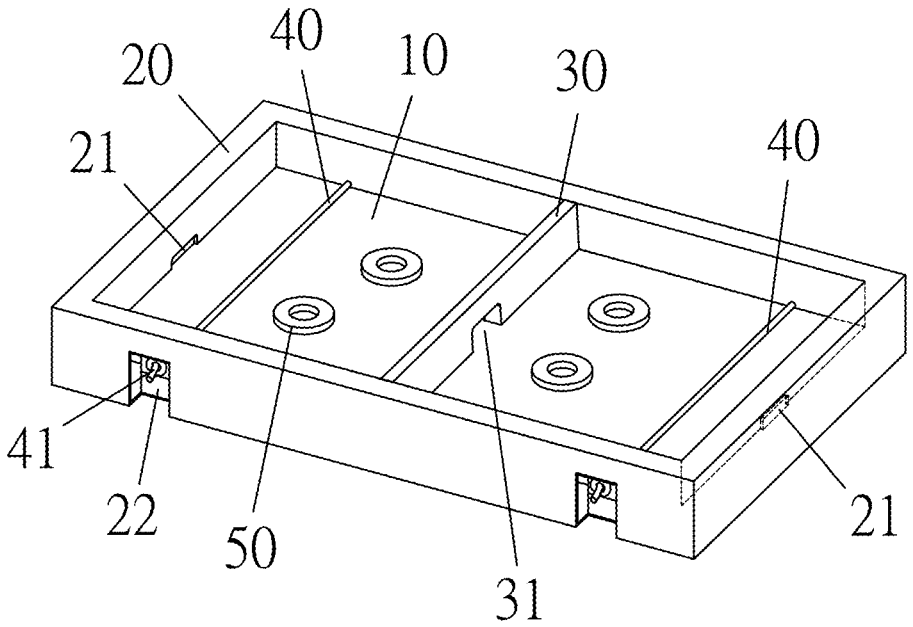
FIG. 1 is a perspective view of the present invention.
Figure 2:
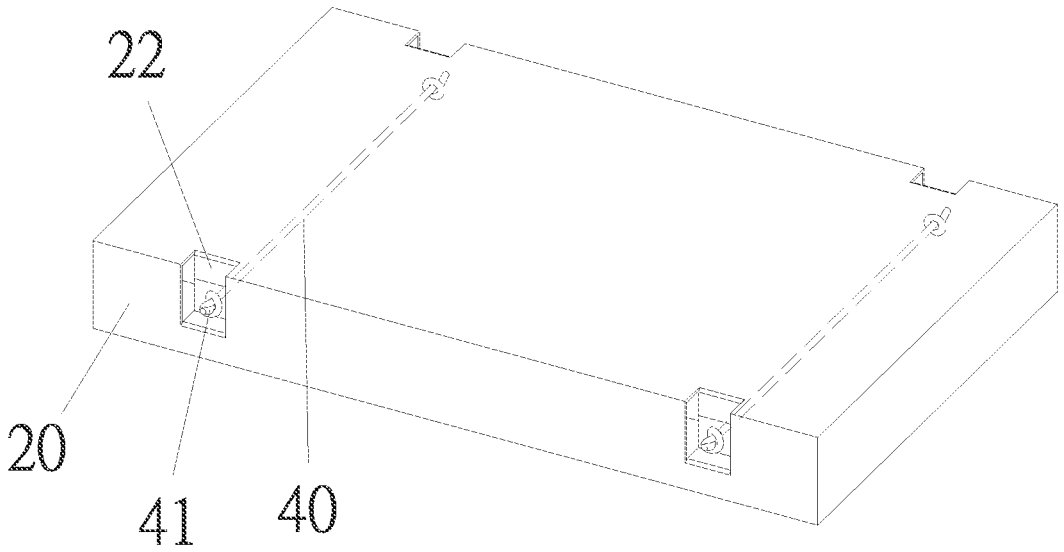
FIG. 2 is a perspective view, taken from an underside, as continuing from FIG. 1.
Figure 3:
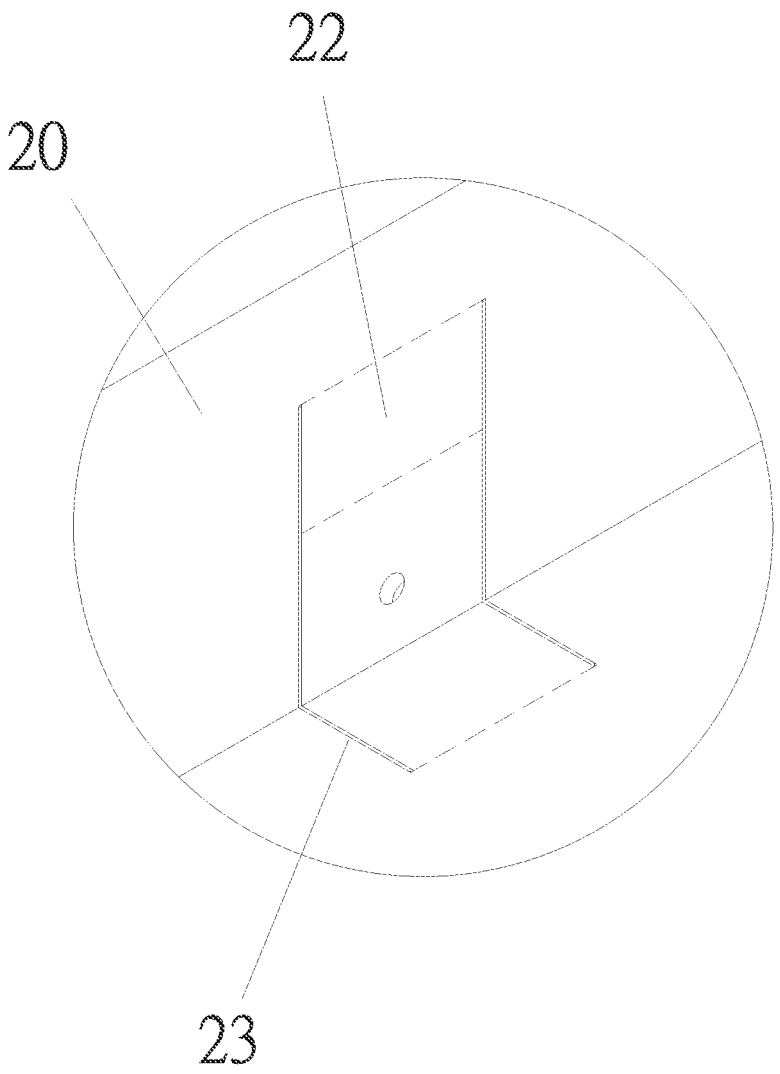
FIG. 3 is an enlarged view of a portion of the present invention, showing a mounting portion and a cutting portion.

In order to expound the technical contents of the present invention, as well as the effectiveness achievable thereby, an embodiment is provided, with reference to the attached drawings, for illustration below. Referring to FIGS. 1-3, the present invention provides a desktop elastic launch game device, which comprises:

- a carrying body 10, which is in the form of a flat board in a rectangular shape, the carrying body 10 having a predetermined height from a bottom surface to a top surface;
- a wall body 20, which has such a height as to be higher than the top surface of the carrying body 10, the wall body 20 being mutually connected and circumferentially arranged around a perimeter of the carrying body 10, the wall body 20 having a predetermined width, the wall body 20 being formed, in an inside surface thereof, with two through holes 21 that are opposite to and corresponding to each other;
- a separation board 30, which is arranged on the carrying body 10 and has two ends mounted to the inside surface of the wall body 20, the separation board 30 having a bottom portion that is formed with a hollowed portion 31 corresponding to each of the through holes 21;
- a plurality of elastic bodies 40, each of which has two ends that are mounted to opposite portions of the inside surface of the wall body 20, each of the elastic bodies 40 being arranged adjacent to each of the through holes 21; and
- a plurality of plate bodies 50, which are each in the form of a flat board in a circular shape, each of the plate bodies 50 having a height and a diameter smaller than the hollowed portion 31.

Figure 4:
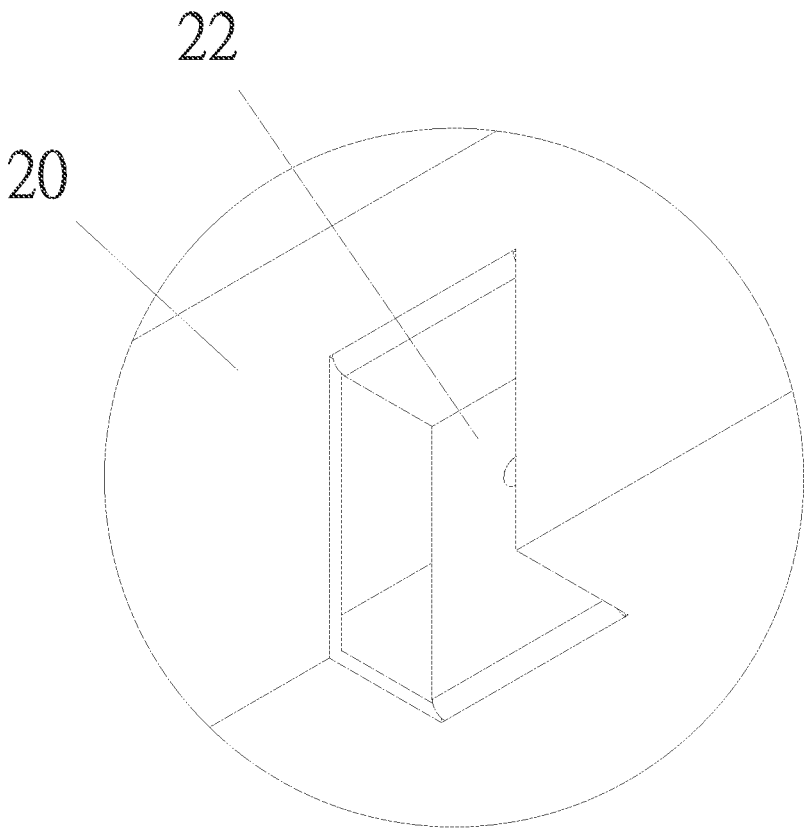
FIG. 4 is a schematic view, continuing from FIG. 3, demonstrating depressing and folding of the mounting portion.

Referring to FIGS. 3 and 4, in the instant embodiment, the wall body 20 has an interior that is made in a hollowed form. An outside surface of the wall body 20 is formed with a plurality of mounting portions 22 arranged at intervals and spaced from each other, and each of the mounting portions 22 has two opposite sides each of which is formed with a longitudinal cutting portion 23 that serves as a fold line or crease for bending, rather that a cutting edge. Each of the cutting portions 23 has a bottom portion that is extended to a bottom surface of the wall body 20 by a predetermined distance, and depressing and folding each of the mounting portions 22 makes each of the mounting portions 22 recessed, along each of the cutting portions 23, inwardly into the interior of the wall body 20.

Referring to FIGS. 1 and 2, the two ends of each of the elastic bodies 40 are combined to the mounting portions 22, respectively. In the instant embodiment, the elastic body 40 comprises an elastic rope, and the two ends of the elastic body 40 penetrate through the wall body 20 and are each tied to make a knot body 41 (rope knotting) attached to and fixed on each mounting portion 22.

The carrying body 10, the wall body 20, and the separation board 30 as discussed above are each made of a paper material and are cut, folded, and combined or adhesively bonded together to make a three-dimensional configuration. Thus, the carrying body 10, the wall body 20, and the separation board 30 all have an interior that is hollow to realize an effect of being lightweight.

Figure 5:
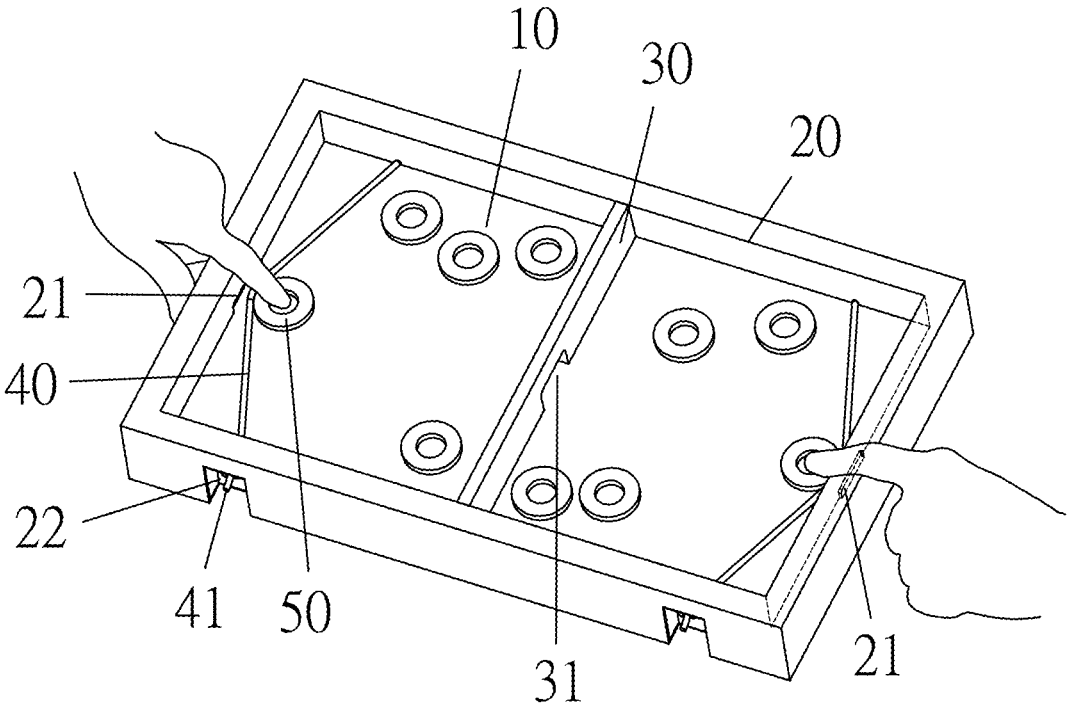
FIG. 5 is a schematic view illustrating operation of the present invention.

Referring to FIG. 5, use or play of the present invention is such that two players each place individual ones of the plate bodies 50 against the elastic bodies 40 in order to apply a spring force of the elastic bodies 40 to eject or launch the plate bodies 50 toward the hollowed portion 31 to realize entertainment of the game for combating.

Further, in the present invention, the mounting portions 22 can be made in the form of troughs or cavities integrally formed with the wall body 20. The two ends of each of the elastic bodies 40 are put through the wall body 20 to be fixed to the mounting portions 22 by making the knot bodies 41. In this way, the structure of the cutting portion 23 and the steps of depressing folding can be omitted.

I claim:

1. A desktop elastic launch game device, comprising:

a carrying body, which is in the form of a flat board in a rectangular shape, the carrying body having a predetermined height from a bottom surface to a top surface;

a wall body, which has such a height as to be higher than the top surface of the carrying body, the wall body being mutually connected and circumferentially arranged around a perimeter of the carrying body, the wall body having a predetermined width, the wall body having an inside surface in which two through holes that are opposite to and correspond to each other are formed;

a separation board, which is arranged on the carrying body and has two ends mounted to an inside surface of the wall body, the separation board having a bottom portion that is formed with a hollowed portion corresponding to each of the through holes;

a plurality of elastic bodies, each of which has two ends that are mounted to opposite portions of the inside surface of the wall body, each of the elastic bodies being arranged adjacent to each of the through holes; and a plurality of plate bodies, which are placeable against each of the elastic bodies so that the plate bodies are selectively launched out toward the hollowed portion by a spring force of the elastic bodies.

2. The desktop elastic launch game device according to claim 1, wherein the wall body is formed, on an outside surface thereof, with a plurality of mounting portions that are arranged at intervals and are spaced from each other, each of the mounting portions having two opposite sides, each of the opposite sides being formed with a longitudinal cutting portion that defines a fold line, such that depressing and folding each mounting portion along the longitudinal cutting portion recesses the mounting portion into an interior of the wall body, and wherein the two ends of each elastic body are respectively mounted to the mounting portions.

3. The desktop elastic launch game device according to claim 2, wherein each of the elastic bodies comprises an elastic rope, and the two ends of each of the elastic bodies penetrate through the wall body and are each tied as a knot body to fix to each of the mounting portions.

4. The desktop elastic launch game device according to claim 2, wherein each longitudinal cutting portion has a bottom portion that is extended to a bottom surface of the wall body by a predetermined distance.

5. The desktop elastic launch game device according to claim 1, wherein each of the plate bodies is made in the form of a flat board in a circular shape, and the plate bodies have a height and a diameter smaller than the hollowed portion.

6. A desktop elastic launch game device, comprising:

a carrying body, which is in the form of a flat board in a rectangular shape, the carrying body having a predetermined height from a bottom surface to a top surface;

a wall body, which has such a height as to be higher than the top surface of the carrying body, the wall body being mutually connected to and circumferentially arranged around a perimeter of the carrying body, the wall body having a predetermined width, the wall body having an inside surface in which two through holes that are opposite to and correspond to each other are formed, the wall body having an outside surface in which a plurality of mounting portions that are arranged at intervals and are spaced from each other are formed, the mounting portions comprising troughs formed integrally with the wall body;

a separation board, which is arranged on the carrying body and has two ends mounted to the inside surface of the wall body, the separation board having a bottom portion that is formed with a hollowed portion corresponding to each of the through holes;

a plurality of elastic bodies, each of which has two ends penetrating through the wall body and respectively mounted to the troughs, each of the elastic bodies being adjacent to a corresponding one of the through holes; and a plurality of plate bodies, which are placeable against each of the elastic bodies so that the plate bodies are selectively launched out toward the hollowed portion by a spring force of the elastic bodies.

7. The desktop elastic launch game device according to claim 6, wherein each of the elastic bodies comprises an elastic rope, and the two ends of each of the elastic bodies penetrate through the wall body and are each tied as a knot body to fix to each of the mounting portions.

8. The desktop elastic launch game device according to claim 6, wherein each of the plate bodies is made in the form of a flat board in a circular shape, and the plate bodies have a height and a diameter smaller than the hollowed portion.

* * * * *